US008979510B2

(12) United States Patent
Shin et al.

(10) Patent No.: US 8,979,510 B2
(45) Date of Patent: Mar. 17, 2015

(54) MICROPUMP AND DRIVING METHOD THEREOF

(75) Inventors: Soo Jai Shin, Daejeon (KR); Hyung Jin Sung, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 436 days.

(21) Appl. No.: 13/293,545

(22) Filed: Nov. 10, 2011

(65) Prior Publication Data

US 2013/0004338 A1 Jan. 3, 2013

(30) Foreign Application Priority Data

Jun. 29, 2011 (KR) ..... 10-2011-0063969

(51) Int. Cl.
*F04B 17/03* (2006.01)
*F04B 19/00* (2006.01)
*F04B 43/04* (2006.01)

(52) U.S. Cl.
CPC ..... *F04B 19/006* (2013.01); *F04B 43/046* (2013.01)
USPC ..... 417/413.2; 417/413.1

(58) Field of Classification Search
CPC .... F04B 43/046; F04B 43/095; F04B 43/088; F04B 43/08
USPC ..... 417/413.2, 474, 475, 413.1
See application file for complete search history.

(56) References Cited

U.S. PATENT DOCUMENTS 3,099,260 A * 7/1963 Birtwell ..... 600/17
3,173,372 A * 3/1965 Baldwin ..... 417/394
3,304,386 A * 2/1967 Shlesinger, Jr. ..... 200/83 B
3,701,618 A * 10/1972 Wall et al. ..... 25/192 R
3,963,380 A * 6/1976 Thomas et al. ..... 417/413.2
4,344,743 A * 8/1982 Bessman et al. ..... 417/317
4,432,699 A * 2/1984 Beckman et al. ..... 417/63
4,515,536 A * 5/1985 van Os ..... 417/394
4,519,751 A * 5/1985 Beckman et al. ..... 417/322
4,822,250 A * 4/1989 Tsubouchi et al. ..... 417/45
5,273,406 A * 12/1993 Feygin ..... 417/474
5,277,556 A * 1/1994 van Lintel ..... 417/413.2
5,798,600 A * 8/1998 Sager et al. ..... 310/330
6,071,088 A * 6/2000 Bishop et al. ..... 417/322
6,254,355 B1 * 7/2001 Gharib ..... 417/53
6,679,687 B2 * 1/2004 Gharib ..... 417/474
6,869,275 B2 * 3/2005 Dante et al. ..... 417/413.2
7,104,768 B2 * 9/2006 Richter et al. ..... 417/423.2
7,163,385 B2 * 1/2007 Gharib et al. ..... 417/474
7,223,363 B2 * 5/2007 McNeely et al. ..... 422/417
7,284,966 B2 * 10/2007 Xu et al. ..... 417/395
7,322,803 B2 * 1/2008 Vogeley ..... 417/413.2

(Continued)

FOREIGN PATENT DOCUMENTS

JP 2004-108285 A 4/2004
JP 2007-092746 A 4/2007

*Primary Examiner* — Charles Freay
*Assistant Examiner* — Alexander Comley
(74) *Attorney, Agent, or Firm* — Gifford, Krass, Sprinkle, Anderson & Citkowski, P.C.

(57) ABSTRACT

A micropump includes: a fluid suction tube for suctioning fluid; a pumping tube connected to the fluid suction tube and providing a suction force and a discharge force to surroundings while repeatedly being expanded and contracted by an external signal; a deform tube connected to the pumping tube and having an aperture that is deformed by the suction force and the discharge force of the pumping tube; and a fluid discharge tube connected to the deform tube and discharging fluid.

6 Claims, 16 Drawing Sheets

(56) References Cited

U.S. PATENT DOCUMENTS

| | | | | |
|---|---|---|---|---|
| 7,387,500 | B2 * | 6/2008 | Gharib | 417/44.1 |
| 7,397,166 | B1 * | 7/2008 | Morgan et al. | 310/328 |
| 7,942,650 | B2 * | 5/2011 | Kitahara et al. | 417/413.2 |
| 8,133,456 | B2 * | 3/2012 | Higashino et al. | 422/505 |
| 2001/0046445 | A1 * | 11/2001 | Gharib | 417/474 |
| 2003/0215342 | A1 * | 11/2003 | Higashino et al. | 417/322 |
| 2004/0101414 | A1 * | 5/2004 | Gharib et al. | 417/53 |
| 2005/0019898 | A1 * | 1/2005 | Adey et al. | 435/286.7 |
| 2007/0048155 | A1 * | 3/2007 | Higashino et al. | 417/413.3 |
| 2010/0158720 | A1 * | 6/2010 | Miyazaki et al. | 417/413.2 |

* cited by examiner

MICROPUMP AND DRIVING METHOD THEREOF

CROSS-REFERENCE TO RELATED APPLICATION

This application claims priority to and the benefit of Korean Patent Application No. 10-2011-0063969 filed in the Korean Intellectual Property Office on Jun. 29, 2011, the entire contents of which are incorporated herein by reference.

BACKGROUND OF THE INVENTION (a) Field of the Invention

The present invention relates to a micropump and a driving method thereof. More particularly, the present invention relates to a valveless micropump and a driving method thereof.

(b) Description of the Related Art

With the development in the micromachining technology, research on microdevices, such as micro-electro mechanical systems (MEMS), has been actively conducted. In the devices, a micropump, a device that manipulates a very small amount of fluid using fluid mechanics, is applied to various fields, including medical chemistry systems and medical equipment, such as chemical analyzing systems and medicine delivery systems, as well as inkjet heads.

When a mechanical valve is adopted to operate the micropump, a friction force for interfering with a normal valve operation is provided because of a fluid characteristic in a microchannel condition. For example, a flow of fluid in a microsystem is very low so it depends on viscosity which is substantially influenced by a change of temperature.

Therefore, a valveless micropump with a long lifespan and great reliability free from the friction force without a mechanical valve is required to be developed.

The valveless micropump is represented by a device for periodically compressing a pincher in an elastic tube to generate a flow, or a device for installing a nozzle action unit and a diffuser action unit in both ends of a pump case in which a piezoelectric actuator is installed and controlling the same to function as a valve.

However, the valveless micropump for generating the flow by periodically compressing the pincher into the elastic tube generates the flow according to a pressure difference caused by superposition and offset phenomena of a pressure wave in the elastic tube, and it is difficult to precisely control the flow rate and generate a large pump pressure because of the above-noted complicated principle of generation.

Also, the valveless micropump with a nozzle action unit and a diffuser action unit installed at both ends of the pump case has a complicated manufacturing process since both the nozzle action unit and the diffuser action unit must be installed at both ends of the pump case.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a micropump that is easy to manufacture, that provides a simple configuration, and that improves pumping performance, and a driving method thereof.

An exemplary embodiment of the present invention provides a micropump including: a fluid suction tube for suctioning fluid; a pumping tube connected to the fluid suction tube and providing a suction force and a discharge force to surroundings while being repeatedly expanded and contracted by an external signal; a deform tube connected to the pumping tube and having an aperture that is deformed by the suction force and the discharge force of the pumping tube; and a fluid discharge tube connected to the deform tube and discharging fluid.

The micropump further includes at least one piezoelectric actuator for applying the external signal to the pumping tube.

The deform tube is provided between an exit of the pumping tube and an entrance of the fluid discharge tube.

An aperture of a central part of the deform tube is reduced by the suction force of the pumping tube, and the aperture of the central part of the deform tube is increased by the discharge force of the pumping tube.

The pumping tube performs a suction mode for suctioning fluid in the surroundings for one period and a discharge mode for discharging the fluid to the surroundings, wherein the pumping tube is expanded in the suction mode and the pumping tube is contracted in the discharge mode.

An aperture of a central part of the deform tube is smaller than an aperture of the fluid suction tube during a period of more than 80% of the entire period of the suction mode.

An aperture of a central part of the deform tube is larger than an aperture of the fluid suction tube during a period of more than 80% of the entire period of the discharge mode.

Another embodiment of the present invention provides a method for driving a micropump, including: expanding a pumping tube having ends connected to a fluid suction tube and a deform tube, respectively, and suctioning fluid in the fluid suction tube and fluid in a fluid discharge tube connected to the deform tube to perform a suction mode; and contracting the pumping tube, and discharging the fluid in the pumping tube to the fluid suction tube and the fluid discharge tube to perform a discharge mode, wherein the pumping tube is repeatedly expanded and contracted by an external signal to provide a suction force and a discharge force to the deform tube, and an aperture of the deform tube is deformed by the suction force and the discharge force of the pumping tube.

An aperture of a central part of the deform tube is smaller than an aperture of the fluid suction tube during a period of more than 80% of the entire period of the suction mode.

An aperture of a central part of the deform tube is larger than an aperture of the fluid suction tube during a period of more than 80% of the entire period of the discharge mode.

According to the embodiments of the present invention, a deform tube is connected to a pumping tube so the pumping process is naturally performed without a valve.

Further, the deform tube is connect to one end of the pumping tube so it is easy to manufacture, its structure is simple, and it can be manufactured in a small size.

In addition, pumping performance is improved since the discharge force can be maximized by changing the aperture of the deform tube.

DETAILED DESCRIPTION OF THE EMBODIMENTS

Figure 1:
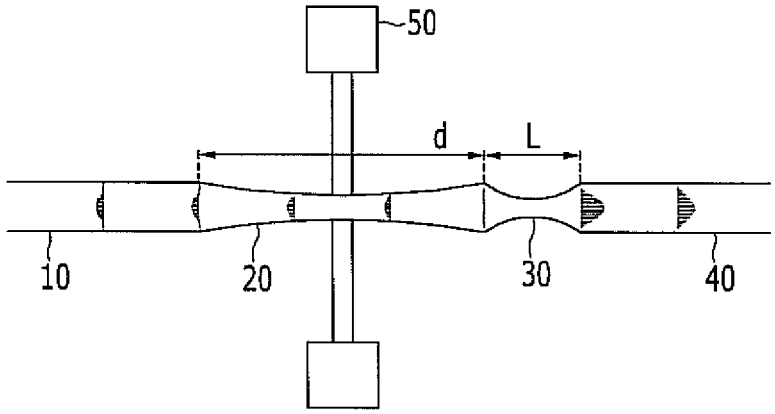
FIG. 1 shows a cross-sectional view of a micropump according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Accordingly, the drawings and description are to be regarded as illustrative in nature and not restrictive, and like reference numerals designate like elements throughout the specification.

A micropump according to an exemplary embodiment of the present invention will now be described in detail with reference to FIG. 1.

FIG. 1 shows a cross-sectional view of a micropump according to an exemplary embodiment of the present invention.

As shown in FIG. 1, the micropump includes a fluid suction tube 10 into which fluid is suctioned, a pumping tube 20 connected to the fluid suction tube 10, a deform tube 30 connected to the pumping tube 20, and a fluid discharge tube 40 connected to the deform tube 30 and discharging the fluid.

The fluid suction tube 10 is manufactured with a rigid material that does not deform so the fluid stably flows through the fluid suction tube 10.

The pumping tube 20 is periodically and repeatedly expanded and contracted by an external signal to provide a suction force and a discharge force to the surroundings. In this instance, an external circumference surface of the pumping tube 20 is changed to have a sinusoidal function with respect to time. Also, intensity of the flow of the fluid inside the pumping tube 20 can be periodically changed to have the sinusoidal function.

At least one piezoelectric actuator 50 for applying an external signal is connected to the pumping tube 20. The pumping tube 20 is expanded when an expansion signal is applied to the pumping tube 20 by the piezoelectric actuator 50, and the pumping tube 20 is contracted when a contraction signal is applied to the pumping tube 20 by the piezoelectric actuator 50.

In this instance, the pumping tube 20 is expanded to provide a suction force to the fluid suction tube 10, the deform tube 30, and the fluid discharge tube 40, and the pumping tube 20 is contracted to provide a discharge force to the fluid suction tube 10, the deform tube 30, and the fluid discharge tube 40.

The deform tube 30 is provided between an exit of the pumping tube 20 and an entrance of the fluid discharge tube 40, and is manufactured with a soft material so that an aperture may be changed by the suction force and the discharge force of the pumping tube 20.

The length (L) of the deform tube 30 is desirably ⅓ to ½ of the length (d) of the pumping tube 20. When the length (L) of the deform tube is less than ⅓ of the length (d) of the pumping tube 20 and when the same is greater than ½ of the length (d) of the pumping tube 20, the aperture of the deform tube 30 is not deformed well by the suction force and discharge force of the pumping tube 20 so the volume of the fluid flowing through the fluid discharge tube 40 may be reduced.

The fluid discharge tube 40 is manufactured with a hard material that is not deformed so it allows the fluid to flow stably through the fluid discharge tube 40.

A method for driving a micropump according to an exemplary embodiment of the present invention will now be described in detail with reference to drawings.

Figure 2:
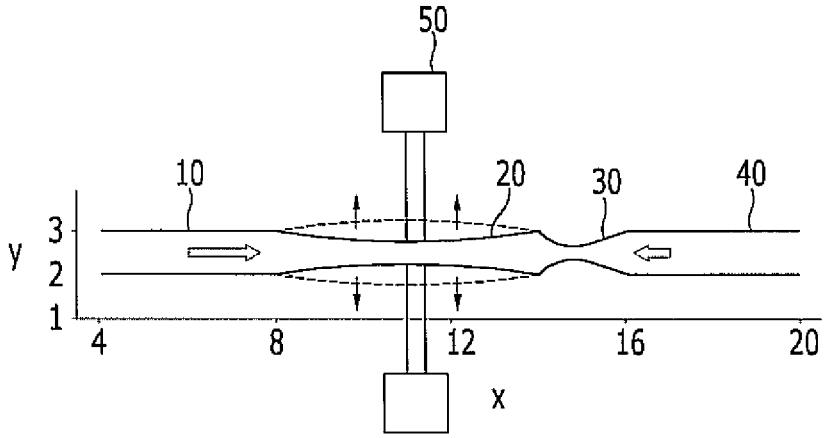
FIG. 2 shows a suction mode of a micropump according to an exemplary embodiment of the present invention.
Figure 3A:
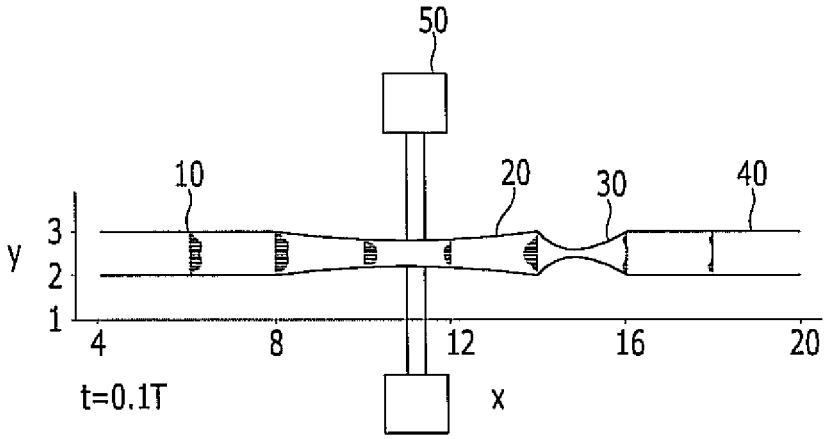
FIG. 3A to FIG. 3E sequentially show a flow of fluid with respect to time in a suction mode of FIG. 2.
Figure 3B:
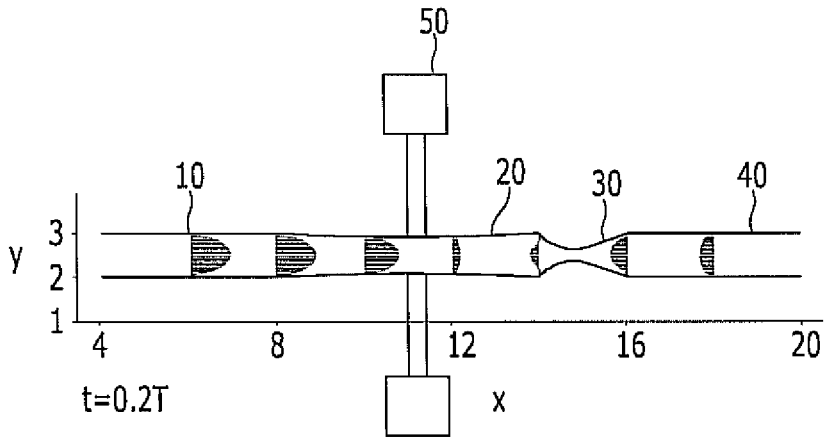
Figure 3C:
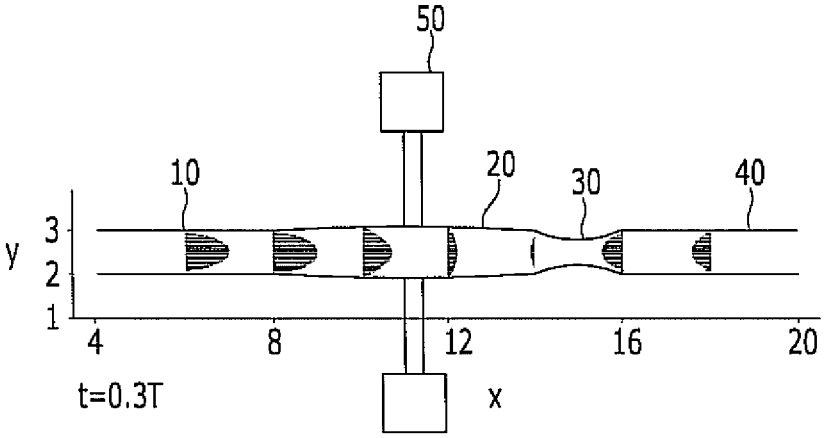
Figure 3D:
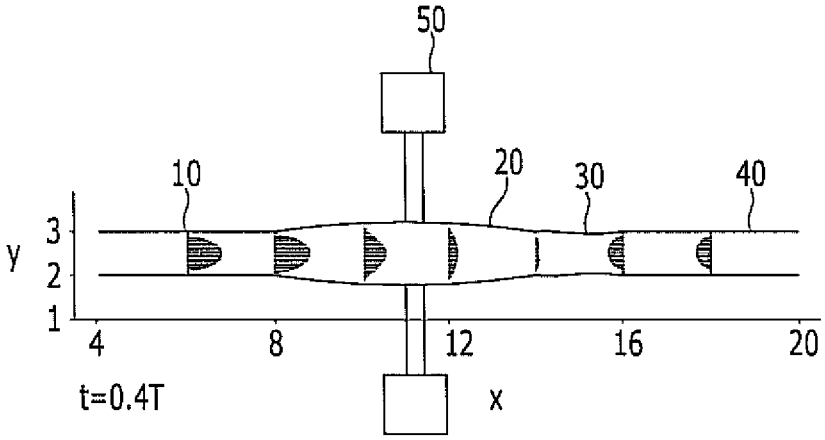
Figure 3E:
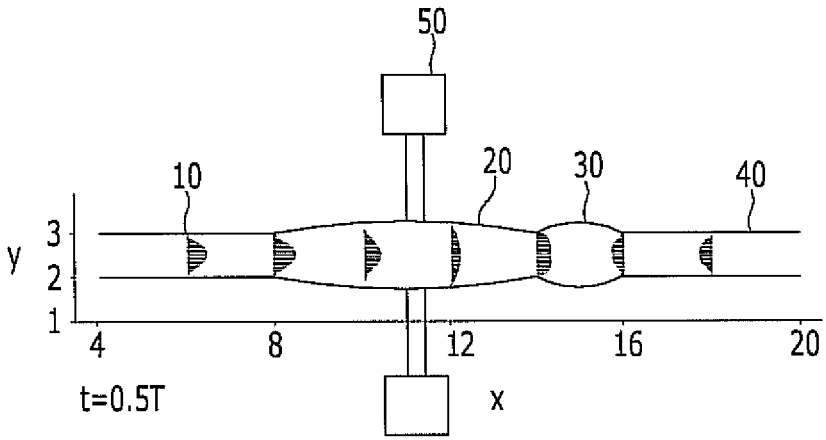
Figure 4:
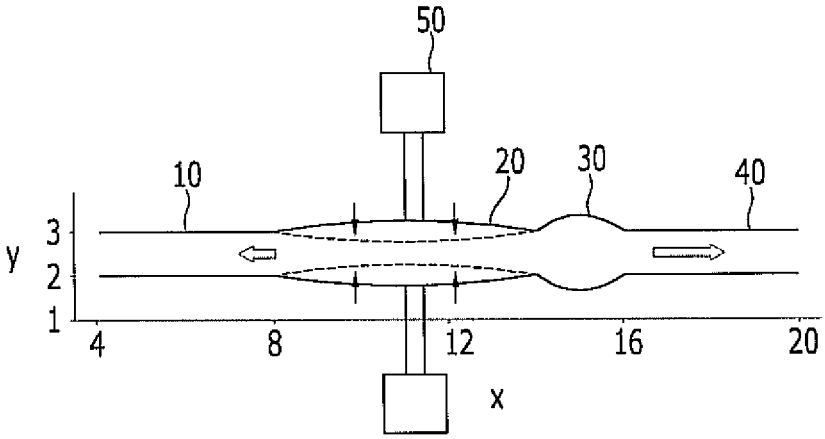
FIG. 4 shows a discharge mode of a micropump according to an exemplary embodiment of the present invention.

FIG. 2 shows a suction mode of a micropump according to an exemplary embodiment of the present invention, FIG. 3A to FIG. 3E sequentially show a flow of fluid with respect to time in a suction mode of FIG. 2, FIG. 4 shows a discharge mode of a micropump according to an exemplary embodiment of the present invention, and FIG. 5A to FIG. 5E sequentially show a flow of fluid with respect to time in a discharge mode of FIG. 4.

As shown in FIG. 2, in the suction mode occupying a former part of one period (T) of the pumping operation, the pumping tube 20 is expanded and the fluid inside the fluid suction tube 10 and the fluid discharge tube 40 is suctioned in a direction of the pumping tube 20. In this instance, the deform tube 30 provided between the exit of the pumping tube 20 and the fluid discharge tube 40 receives the suction force caused by the pumping tube 20 and is then contracted, and during most of the period of the suction mode, that is, greater than 80% of the period, the aperture of the central part of the deform tube 30 can be smaller than the aperture of the fluid suction tube 10. When the aperture of the central part of the deform tube 30 is smaller than the aperture of the fluid suction tube 10 during the period that is less than 80% of the entire suction mode, the amount of fluid progressing toward the pumping tube 20 from the fluid discharge tube 40 may be greater than the amount of fluid progressing toward the pumping tube 20 from the fluid suction tube 10.

Therefore, the progress of the fluid that moves toward the pumping tube 20 from the fluid discharge tube 40 in the suction mode is interrupted by the contracted deform tube 30 so the amount of the fluid progressing toward the pumping tube 20 from the fluid discharge tube 40 becomes less than the amount of the fluid progressing toward the pumping tube 20 from the fluid suction tube 10.

The flow of the fluid with respect to time in the suction mode will now be described in detail.

As shown in FIG. 3A, when the pumping time (t) is 0.1 T, the pumping tube 20 and the deform tube 30 are contracted. In this instance, the aperture of the fluid suction tube 10 is smaller than the aperture at the central part of the deform tube 30. Therefore, the amount of the fluid progressing to the pumping tube 20 from the fluid discharge tube 40 becomes less than the amount of fluid progressing toward the pumping tube 20 from the fluid suction tube 10.

As shown in FIG. 3B, when the pumping time (t) is 0.2 T, the pumping tube 20 and the deform tube 30 are expanded little by little. The contracted deform tube 30 receives an expansive force because of the elastic force. In this instance, the deform tube 30 is contracted more than the fluid suction tube 10.

As shown in FIG. 3C, when the pumping time (t) is 0.3 T, the pumping tube 20 and the deform tube 30 are continuously expanded. In this instance, the deform tube 30 is further contracted than the fluid suction tube 10.

As shown in FIG. 3D, when the pumping time (t) is 0.4 T, the pumping tube 20 and the deform tube 30 are continuously expanded. In this instance, the aperture of the central part of the deform tube 30 is contracted more than the fluid suction tube 10.

Therefore, the progress of the fluid moving toward the pumping tube 20 from the fluid discharge tube 40 in the suction mode is hindered by the contracted deform tube 30 so the flow velocity of the fluid moving toward the pumping tube 20 from the fluid discharge tube 40 becomes less than the flow velocity of the fluid moving toward the pumping tube 20 from the fluid suction tube 10.

As described, when the direction of the fluid flowing toward the fluid discharge tube 40 from the fluid suction tube 10 is defined to be a positive fluid direction, the fluid flows toward the fluid discharge tube 40 from the fluid suction tube 10 in the positive fluid direction in the suction mode.

As shown in FIG. 3E, when the pumping time (t) is 0.5 T, the fluid flows in the positive direction in the pumping tube 20 and it flows in the negative direction in the fluid discharge tube 40, and resultantly, the flow gathers toward the deform tube 30 and the deform tube 30 is expanded.

As shown in FIG. 4, in the discharge mode occupying a latter part of one period (T) of the pumping operation, the pumping tube 20 is contracted and the fluid inside the fluid suction tube 10 and the fluid discharge tube 40 is discharged to the outside. In this instance, the deform tube 30 provided between the exit of the pumping tube 20 and the fluid discharge tube 40 is expanded by receiving the discharge force caused by the pumping tube 20, and during most of the period of the discharge mode, that is, greater than 80% of the period, the aperture of the central part of the deform tube 30 can be larger than the aperture of the fluid suction tube 10. When the aperture of the central part of the deform tube 30 is larger than the aperture of the fluid suction tube 10 during the period that is less than 80% of the entire period of the discharge mode, the amount of fluid progressing toward the fluid discharge tube 40 from the pumping tube 20 may be problematically less than the amount of the fluid progressing toward the fluid suction tube 10 from the pumping tube 20.

Therefore, the progress of the fluid moving toward the fluid discharge tube 40 from the pumping tube 20 in the discharge mode becomes fluent by the expanded deform tube 30 so the amount of the fluid moving toward the fluid discharge tube 40 from the pumping tube 20 becomes greater than the amount of the fluid moving toward the fluid suction tube 10 from the pumping tube 20.

A flow of the fluid with respect to time in the discharge mode will now be described in detail.

Figure 5A:
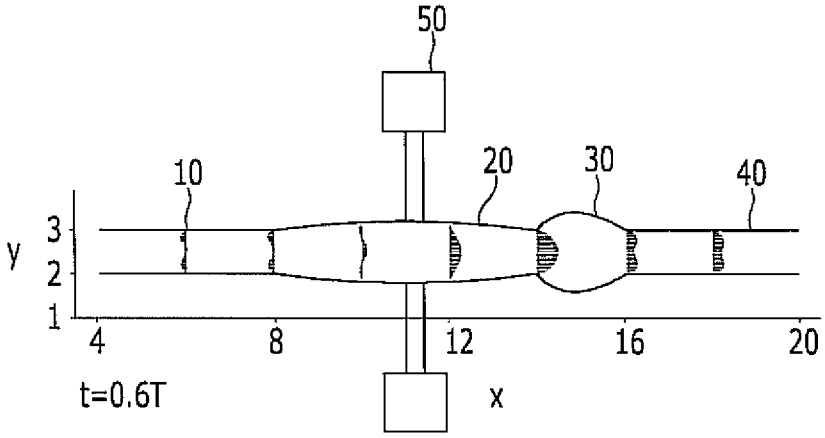
FIG. 5A to FIG. 5E sequentially show a flow of fluid with respect to time in a discharge mode of FIG. 4.

As shown in FIG. 5A, when the pumping time (t) is 0.6 T, the pumping tube 20 and the deform tube 30 are expanded. In this instance, the deform tube 30 is expanded more than the pumping tube 20, and the aperture of the central part of the deform tube 30 is larger than the aperture of the fluid suction tube 10. Therefore, the amount of fluid moving toward the fluid discharge tube 40 from the pumping tube 20 becomes greater than the amount of fluid moving toward the fluid suction tube 10 from the pumping tube 20.

Figure 5B:
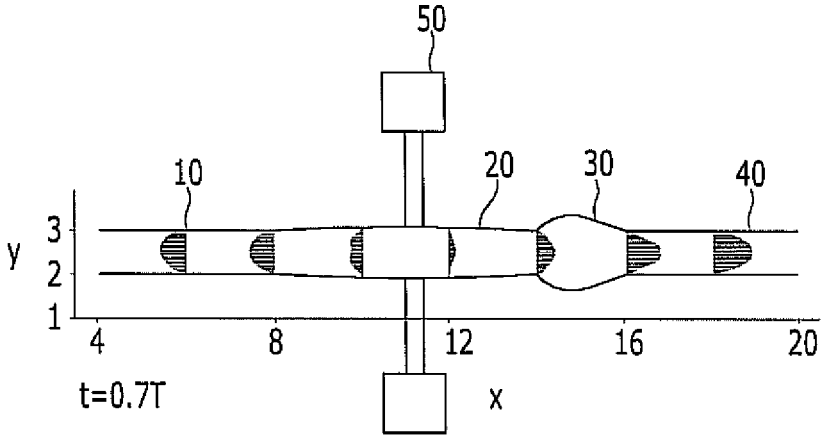

As shown in FIG. 5B, when the pumping time (t) is 0.7 T, the pumping tube 20 and the deform tube 30 are gradually contracted. The expanded deform tube 30 additionally receive a contractive force because of the elastic force. In this instance, the deform tube 30 is expanded more than the fluid suction tube 10.

Figure 5C:
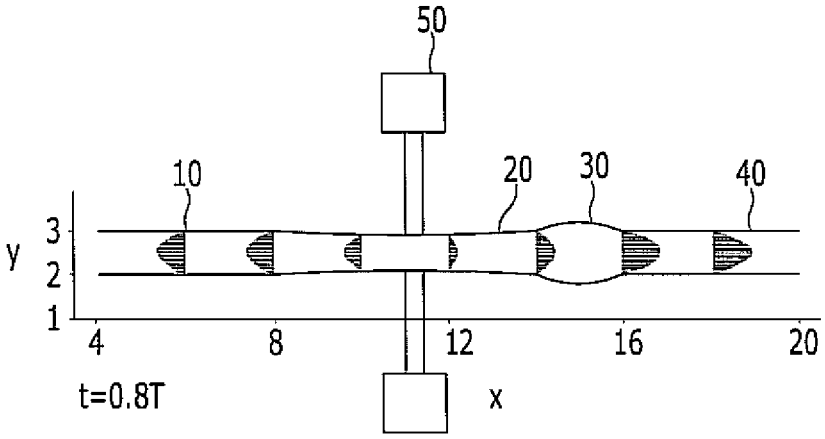

As shown in FIG. 5C, when the pumping time (t) is 0.8 T, the pumping tube 20 and the deform tube 30 are continuously contracted. In this instance, the deform tube 30 is expanded more than the fluid suction tube 10.

Figure 5D:
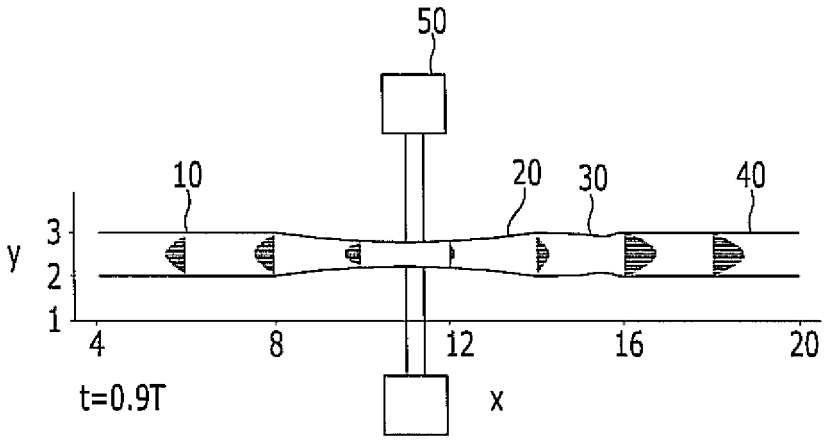

As shown in FIG. 5D, when the pumping time (t) is 0.9 T, the pumping tube 20 and the deform tube 30 are continuously contracted. In this instance, contraction degrees of the aperture of the fluid suction tube 10 and the deform tube 30 are almost the same.

Therefore, the progress of the fluid moving toward the fluid discharge tube 40 from the pumping tube 20 in the discharge mode becomes fluent by the expanded deform tube 30 so the flow velocity of the fluid progressing toward the fluid discharge tube 40 from the pumping tube 20 becomes greater than the flow velocity of the fluid moving toward the fluid suction tube 10 from the pumping tube 20.

Figure 5E:
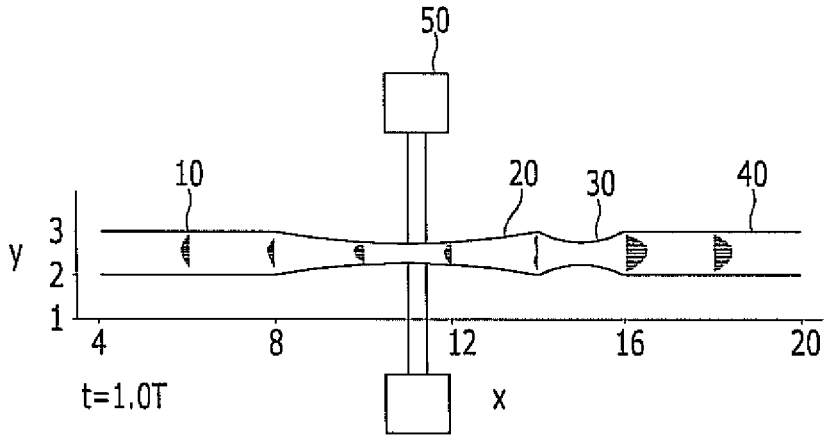

Accordingly, as shown in FIG. 5E, when the pumping time (t) is 1.0 T, the fluid flows in the negative direction in the pumping tube 20, and the fluid flows in the positive direction in the fluid discharge tube 40 so the fluid goes out of the deform tube 30 to contract the deform tube 30.

Hence, the fluid flows toward the fluid discharge tube 40 from the fluid suction tube 10 in the positive flow direction in the discharge mode.

Therefore, the micropump according to the exemplary embodiment of the present invention can function as a pump by controlling the fluid to flow in the positive flow direction in the suction mode and the discharge mode by using the deform tube 30 without an additional valve.

Figure 6:
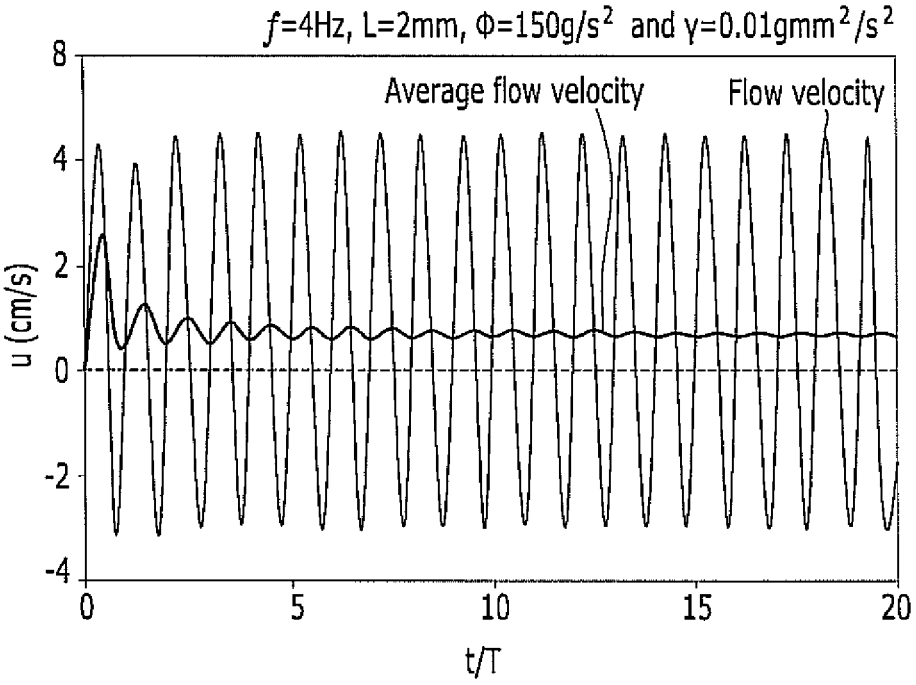
FIG. 6 shows a flow velocity (u) that is measured with respect to time at a central part of a fluid suction tube of a micropump according to an exemplary embodiment of the present invention, and an average flow velocity with respect to time.
Figure 7:
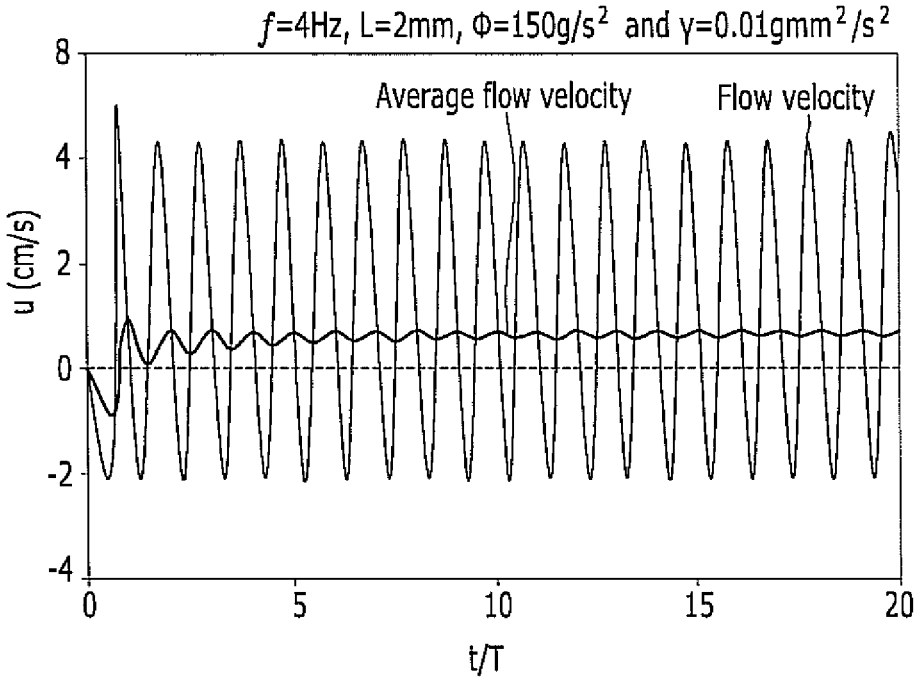
FIG. 7 shows a flow velocity and an average flow velocity measured at a central part of a fluid discharge tube of a micropump according to an exemplary embodiment of the present invention.

FIG. 6 shows a flow velocity (u) that is measured with respect to time at a central part of a fluid suction tube of a micropump according to an exemplary embodiment of the present invention, and an average flow velocity with respect to time, and FIG. 7 shows a flow velocity and an average flow velocity measured at a central part of a fluid discharge tube of a micropump according to an exemplary embodiment of the present invention.

As shown in FIG. 6, the fluid has the average flow velocity of substantially 0.5 cm/s in the fluid suction tube 10 so the fluid flows in the positive flow direction. Therefore, the fluid passing through the fluid suction tube 10 moves to the exit of the fluid suction tube 10 from the entrance of the fluid suction tube 10.

Also, as shown in FIG. 7, the fluid has the average flow velocity of substantially 0.5 cm/s in the fluid discharge tube 40 so the fluid flows in the positive flow direction. Therefore, the fluid passing through the fluid discharge tube 40 moves to the exit of the fluid discharge tube 40 from the entrance of the fluid discharge tube 40.

Further, it is checked that the average flow velocity measured at the central part of the fluid suction tube 10 corresponds to the average flow speed measured at the central part of the fluid discharge tube 40.

An influence of a stretching coefficient (ϕ) of the deform tube to pumping will now be described in detail with reference to drawings.

Figure 8:
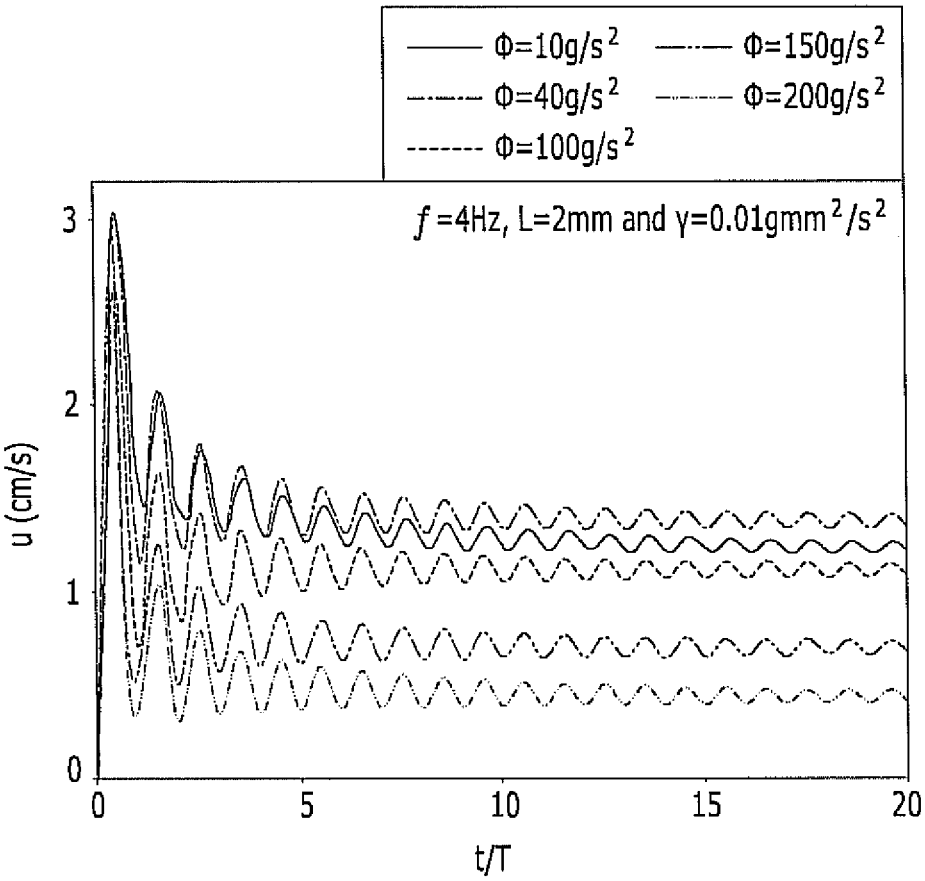
FIG. 8 shows an average flow velocity at a central part of a fluid suction tube according to a stretching coefficient (ϕ) of a deform tube of a micropump according to an exemplary embodiment of the present invention.
Figure 9:
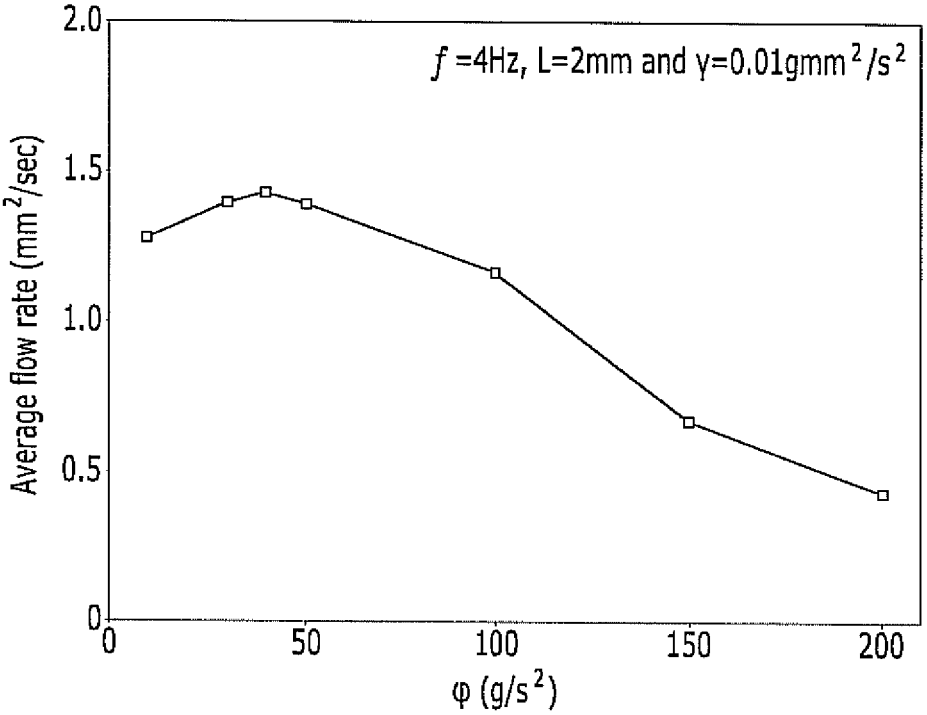
FIG. 9 shows an average flow velocity at a central part of a fluid suction tube according to a stretching coefficient (ϕ) of a deform tube measured after 20 periods have progressed.

FIG. 8 shows an average flow velocity at a central part of a fluid suction tube according to a stretching coefficient (ϕ) of a deform tube of a micropump according to an exemplary embodiment of the present invention, and FIG. 9 shows an average flow velocity at a central part of a fluid suction tube according to a stretching coefficient (ϕ) of a deform tube measured after 20 periods have progressed. Here, the pumping frequency (f) of the pumping tube 20 is fixed to be 4 Hz, the length (L) of the deform tube 30 is fixed to be 2 mm, and the bending coefficient (γ) of the deform tube 30 is fixed to be 0.01 g $mm^2/s^2$. As the stretching coefficient becomes greater, it signifies that greater force is needed to be extended in the length direction of the deform tube 30. That is, a small stretching coefficient represents a soft deform tube 30 and a large stretching coefficient represent a hard deform tube 30.

As shown in FIG. 8 and FIG. 9, the average flow velocity becomes maximized when the stretching coefficient of the deform tube 30 is 40 $g/s^2$, and the average flow velocity is reduced when the stretching coefficient of the deform tube 30 is greater than 50 $g/s^2$ or less than 30 $g/s^2$. Therefore, the stretching coefficient of the deform tube 30 is desirably 30 $g/s^2$ to 50 $g/s^2$.

An influence of the bending coefficient (γ) of the deform tube to pumping will now be described in detail with reference to a drawing.

Figure 10:
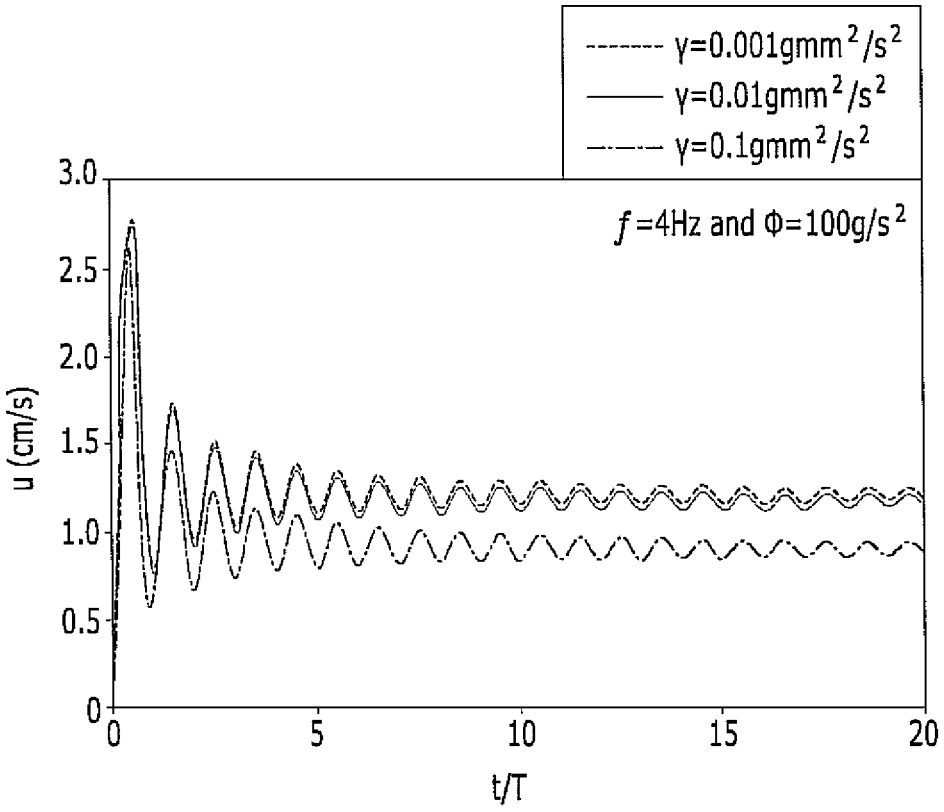
FIG. 10 shows an average flow velocity at a central part of a fluid suction tube according to a bending coefficient (γ) of a deform tube of a micropump according to an exemplary embodiment of the present invention.

FIG. 10 shows an average flow velocity at a central part of a fluid suction tube according to a bending coefficient (γ) of a deform tube of a micropump according to an exemplary embodiment of the present invention. Here, the pumping frequency (f) of the pumping tube 20 is fixed to be 4 Hz, the length (L) of the deform tube 30 is fixed to be 2 mm, and the stretching coefficient (ϕ) of the deform tube 30 is fixed to be 100 $g/s^2$. When the bending coefficient becomes greater, it means that much force is needed to be bent in the vertical direction of the deform tube 30.

As shown in FIG. 10, it is found that the average flow velocity becomes greater as the bending coefficient of the deform tube 30 becomes lesser. However, when the bending coefficient of the deform tube 30 becomes less than 0.01 g $mm^2/s^2$ to be 0.001 g $mm^2/s^2$, it is found that an increase of the average flow velocity is not great. Also, when the bending coefficient of the deform tube 30 is greater than 0.1 g $mm^2/s^2$, the deform tube 30 is less deformed and the average flow velocity is substantially reduced. Therefore, it is desirable for the bending coefficient of the deform tube 30 to be greater than 0.001 g $mm^2/s^2$ and less than 0.01 g $mm^2/s^2$.

An influence of the length of the deform tube on pumping will now be described in detail with reference to a drawing.

Figure 11:
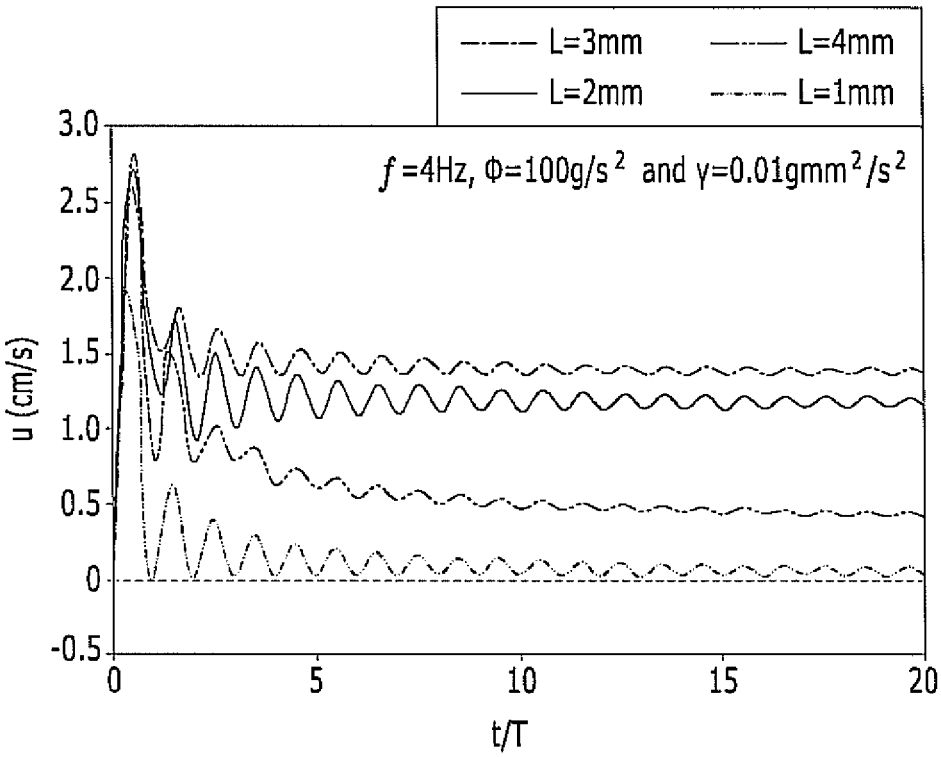
FIG. 11 shows an average flow velocity at a central part of a fluid suction tube according to a length of a deform tube of a micropump according to an exemplary embodiment of the present invention.

FIG. 11 shows an average flow velocity at a central part of a fluid suction tube according to a length of a deform tube of a micropump according to an exemplary embodiment of the present invention. Here, the pumping frequency (f) of the pumping tube 20 is fixed to be 4 Hz, the diameter of the deform tube 30 is fixed to be 1 mm, the stretching coefficient (ϕ) of the deform tube 30 is fixed to be 100 $g/s^2$, and the bending coefficient (γ) of the deform tube 30 is fixed to be 0.01 g $mm^2/s^2$.

As shown in FIG. 11, the average flow velocity is maximized when the diameter of the deform tube 30 is 1 mm and the length (L) of the deform tube 30 is 3 mm, and the average flow velocity is substantially reduced when the length (L) of the deform tube 30 is greater than 3 mm or less than 2 mm. Therefore, it is desirable for the aspect ratio of the deform tube 30 to be 2 to 3.

An influence of the pumping frequency of the pumping tube on pumping will now be described in detail with reference to a drawing.

Figure 12:
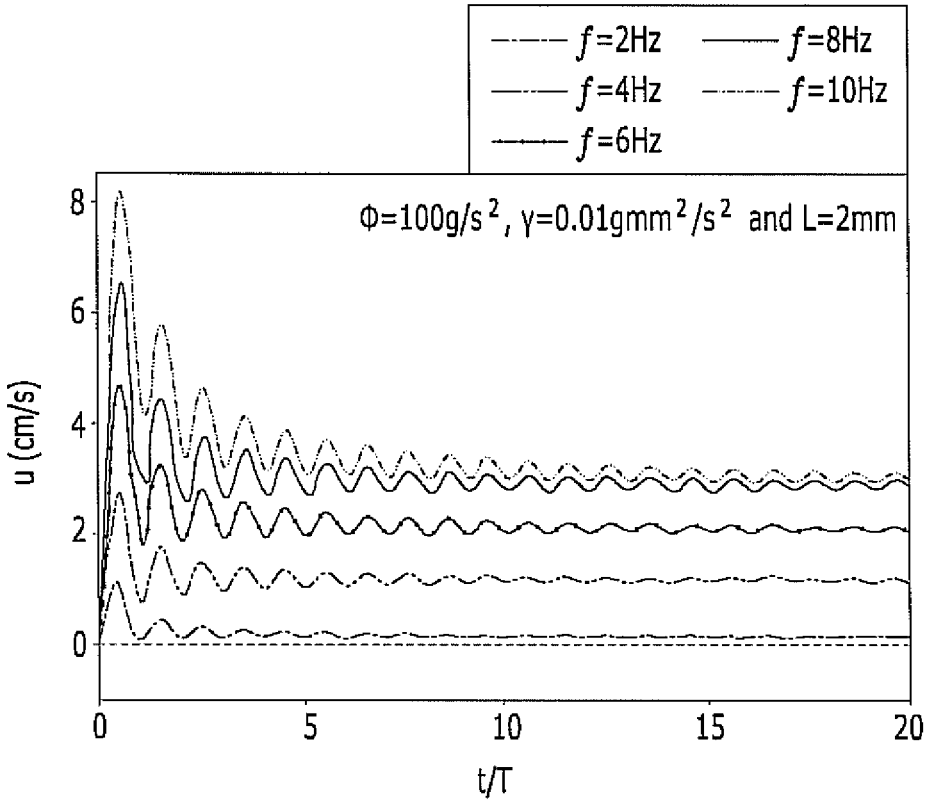
FIG. 12 shows an average flow velocity at a central part of a fluid suction tube according to a pumping frequency of a pumping tube of a micropump according to an exemplary embodiment of the present invention.

FIG. 12 shows an average flow velocity at a central part of a fluid suction tube according to a pumping frequency of a pumping tube of a micropump according to an exemplary embodiment of the present invention. Here, the length (L) of the deform tube 30 is fixed to be 2mm, the stretching coefficient (ϕ) of the deform tube 30 is fixed to be 100 $g/s^2$, and the bending coefficient (γ) of the deform tube 30 is fixed to be 0.01 g $mm^2/s^2$. As the pumping frequency of the pumping tube 20 becomes greater, it signifies that the force applied to the fluid by the pumping tube 20 is increased.

As shown in FIG. 12, it is found that the average flow velocity is increased as the pumping frequency of the pumping tube 20 becomes greater. However, when the pumping frequency of the pumping tube 20 is greater than 8 Hz, the increase of the average flow velocity is reduced, and when the pumping frequency of the pumping tube 20 is less than 4 Hz, the average flow velocity is substantially reduced. Therefore, it is desirable for the pumping frequency of the pumping tube 20 to be greater than 4 Hz and less than 8 Hz.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A micropump comprising: a fluid suction tube for suctioning fluid; a pumping tube connected to the fluid suction tube and providing a suction force and a discharge force to surroundings while being repeatedly expanded and contracted by an external signal; a deform tube connected to the pumping tube and having an aperture that is deformed by the suction force and the discharge force of the pumping tube; and a fluid discharge tube connected to the deform tube and discharging fluid; wherein an aperture of an entrance of the deform tube is constant while the pumping tube is expanded and contracted: wherein the deform tube is provided between an exit monolithically formed with the pumping tube and an entrance monolithically formed with the fluid discharge tube and the exit of the pumping tube is in direct contact with the entrance of the deform tube.

2. The micropump of claim 1, further including at least one piezoelectric actuator for applying the external signal to the pumping tube.

3. The micropump of claim 1, wherein an aperture of a central part of the deform tube is reduced by the suction force of the pumping tube, and the aperture of the central part of the deform tube is increased by the discharge force of the pumping tube.

4. The micropump of claim 1, wherein for one period the pumping tube performs a suction mode for suctioning fluid in the surroundings and a discharge mode for discharging the fluid to the surroundings, wherein the pumping tube is expanded in the suction mode and the pumping tube is contracted in the discharge mode.

5. The micropump of claim 4, wherein an aperture of a central part of the deform tube is smaller than an aperture of the fluid suction tube during a period of more than 80% of an entire period of the suction mode.

6. The micropump of claim 4, wherein an aperture of a central part of the deform tube is larger than an aperture of the fluid suction tube during a period of more than 80% of an entire period of the discharge mode.

* * * * *